US008652736B2

(12) United States Patent
Nakao et al.

(10) Patent No.: US 8,652,736 B2
(45) Date of Patent: Feb. 18, 2014

(54) ELECTROPHOTOGRAPHIC DEVELOPER CARRIER CORE MATERIAL, ELECTROPHOTOGRAPHIC DEVELOPER CARRIER, METHODS OF MANUFACTURING THE SAME, AND ELECTROPHOTOGRAPHIC DEVELOPER

(75) Inventors: Ryusuke Nakao, Okayama (JP); Takeshi Kawauchi, Okayama (JP)

(73) Assignees: Dowa IP Creation Co., Ltd., Okayama (JP); Dowa Electronics Materials Co., Ltd., Tokyo (JP)

( * ) Notice: Subject to any disclaimer, the term of this patent is extended or adjusted under 35 U.S.C. 154(b) by 843 days.

(21) Appl. No.: 11/992,675

(22) PCT Filed: Sep. 25, 2006

(86) PCT No.: PCT/JP2006/318902

§ 371 (c)(1),
(2), (4) Date: Jul. 18, 2008

(87) PCT Pub. No.: WO2007/037182

PCT Pub. Date: Apr. 5, 2007

(65) Prior Publication Data

US 2009/0258311 A1 Oct. 15, 2009

(30) Foreign Application Priority Data

Sep. 29, 2005 (JP) ..... 2005-285652

(51) Int. Cl.
*G03G 9/00* (2006.01)

(52) U.S. Cl.
USPC ..... 430/111.41; 430/111.1; 430/111.2; 430/111.3; 430/111.4

(58) Field of Classification Search
USPC ..... 430/11.1–11.4, 11.31, 111.1–111.4, 430/111.31
See application file for complete search history.

(56) References Cited

U.S. PATENT DOCUMENTS 4,233,387 A * 11/1980 Mammino et al. ..... 430/111.3
4,518,674 A * 5/1985 Watanabe et al. ..... 430/111.34
4,640,880 A * 2/1987 Kawanishi et al. ..... 430/122.4
5,573,880 A * 11/1996 Mayama et al. ..... 430/111.3
6,528,225 B1 3/2003 Mahabadi et al.
2003/0044712 A1* 3/2003 Matsui et al. ..... 430/111.32
2005/0164110 A1* 7/2005 Yaguchi et al. ..... 430/108.4

FOREIGN PATENT DOCUMENTS

EP 1 729 180 A1 12/2006
JP A 61-007851 1/1986
JP A 2-145061 6/1990
JP 08160673 A * 6/1996
JP A 08-194338 7/1996

OTHER PUBLICATIONS http://www.magneticpowders.com/MnZn-soft-ferrite-powder.html, Zhejiang Ante Magnetic material Co., Ltd 2006.*
http://www.csgnetwork.com/specificgravmattable.html, 1973-2011 CSG, Computer Support Group, Inc. and CSGNetwork.Com.*
English translation of JP 08160673 A, Tamura, Japan, Jun. 1996.*
Sep. 29, 2010 European Search Report issued in EP 06 81 0470.
Feb. 29, 2012 European Search Report issued in EP 12 00 0034.4.

* cited by examiner

*Primary Examiner* — Mark F Huff
*Assistant Examiner* — Rashid Alam
(74) *Attorney, Agent, or Firm* — Oliff PLC

(57) ABSTRACT

The present invention provides a carrier core material for use in the production of an electrophotographic developer which, even when applied, for example, to MFPs (multifunction printers), can realize stable, high-quality and high-speed development, and has a prolonged replacing life of magnetic carriers, and a method of manufacturing the same, a magnetic carrier including the carrier core material, and an electrophotographic developer manufactured from the magnetic carrier. An electrophotographic development carrier is prepared by adding resin particles, a binder, a dispersant, a wetting agent, and water to a raw material powder, wet pulverizing the mixture, drying the pulverized product to give granulated powder, calcinatng the granulated powder, and then sintering the granulated powder to prepare a carrier core material having an internally hollow structure, and coating the carrier core material with a resin. An electrophotographic developer is manufactured by mixing the electrophotographic development carrier with a toner.

18 Claims, No Drawings

ELECTROPHOTOGRAPHIC DEVELOPER CARRIER CORE MATERIAL, ELECTROPHOTOGRAPHIC DEVELOPER CARRIER, METHODS OF MANUFACTURING THE SAME, AND ELECTROPHOTOGRAPHIC DEVELOPER

TECHNICAL FIELD

The present invention relates to an electrophotographic developer carrier core material contained in an electrophotographic developer carrier employed for electrophotographic development, an electrophotographic developer carrier in which the electrophotographic developer carrier core material is employed, methods of manufacturing the same, and an electrophotographic developer containing the electrophotographic developer carrier.

BACKGROUND ART

An electrophotographic dry development method describes a method of development based on a powdered toner serving as a developer being affixed to an electrostatic latent image of a photosensitive material, and the affixed toner being transferred onto a predetermined paper or the like. Electrophotographic dry development methods may be divided into single-component development methods that employ a single component developer containing a toner alone, and two-component development methods that employ a two-component developer containing a toner and a magnetic electrophotographic developer carrier (hereinafter, also referred to as a magnetic carrier). Because of the stable high-image quality and capacity for high-speed development afforded by the simplification of toner charge control in recent years, two-component development methods are now widely employed.

While the trend in electrophotographic development apparatuses is toward apparatuses that enable full-color imaging and high-speed development with high-image quality, polymerized toners of small particle diameter have been developed as the toner employed to achieve the same, and development of magnetic carriers of small particle diameter and compatible with polymerized toners of small particle diameter is well under way. The market for so-called MFP (multi-function printer) electrophotographic development apparatuses has expanded accompanying the popularization of personal computers, and while simultaneously with these electrophotographic development apparatuses executing functions based on ancillary applications or the like, they are unfavorably appraised from the viewpoint of not only their document output capacity but also their running costs.

The running costs of an electrophotographic development apparatus are largely dependent on the cost of consumables such as the toner and magnetic carrier. Most magnetic carriers employ a spherical soft ferrite as an electrophotographic developer carrier core material (hereinafter also referred to as a carrier core material.) and, while a resin is coated on the surface of these spherical soft ferrites, the resin on the surface deteriorates as the print copy number increases due to abrasion caused by the magnetic carriers until a stage at which it is unfit for electrophotographic development is reached. For this reason, in most electrophotographic development apparatuses the magnetic carrier and toner are simultaneously replaced subsequent to a set value of the counted document print copy number being reached.

Patent Document 1 proposes a method of manufacturing a carrier core material of low density and low specific gravity in which, based on the use of a carbonate starting material as a carrier core material starting material and the utilization of the gasified component of this starting material, a hollow structure is generated in the carrier core material.

[Patent Document 1] Japanese Unexamined Patent Application Publication No. S61-7851

The inventors of the present invention theorized the importance of reducing stress on the resin on the surface of the carrier core material for extending the replacement interval of a magnetic carrier. Furthermore, the inventors theorized that the stress that a carrier core material is subjected to when an electrophotographic developer is being agitated and mixed in an electrophotographic development apparatus can be reduced by reducing the specific gravity of the core material. It was apparent from examinations conducted by the inventors of the present invention that the manufacture of an electrophotographic developer employing a magnetic carrier manufactured by the method of manufacturing described in, for example, Patent Document 1, and the employment of this electrophotographic developer employed in an MFP or the like does not afford an extended magnetic carrier replacement interval.

Thereupon, the inventors of the present invention conducted further examinations as to the reasons preventing the replacement interval of a conventional magnetic carrier from being extended. The following was apparent as a result thereof. That is to say, while gasification of a carbonate starting material progresses when a carrier core material starting material is calcined and a hollow structure is formed in a calcined powder, this hollow structure is pulverized in a wet pulverization step implemented on this calcined power in which a hollow structure is formed in a ball mill that follows the calcination step. This is thought to be because, while a hollow structure is formed in a sintered powder generated in a subsequent sintering step as a result of the gasification of a residual portion of the carbonate starting material, the extent of this formation is restricted.

Furthermore, Patent Document 1 describes a configuration in which some of the carbonate starting material is apportioned for addition to the calcined starting material powder and sintered. However, it was apparent from examinations conducted by the inventors of the present invention that employment of the electrophotographic developer containing the magnetic carrier in which this configuration is employed in an above-noted MFP or the like does not afford an extended magnetic carrier replacement interval.

Thereupon, the inventors of the present invention conducted examinations as to the reasons preventing the replacement interval of this magnetic carrier from being extended. As a result, the reason preventing the magnetic carrier replacement interval of this configuration from being extended was thought to reside in an inadequate amount of gas being generated from the carbonate starting material and, as a natural outcome thereof, the formation of the hollow structure in the sintering step being restricted thereby.

DISCLOSURE OF THE INVENTION

Thereupon, the problems to be resolved by the present invention reside in the provision of a carrier core material for manufacturing an electrophotographic developer that enables high-speed development with stable high-image quality even when employed in an MFP or the like as the electrophotographic development apparatus and in which the magnetic carrier has a long replacement interval, and a magnetic carrier containing this carrier core material and methods of manufacturing the same, and an electrophotographic developer manufactured from the magnetic carrier.

The inventors of the present invention carried out research into the structure and physical characteristics of a magnetic carrier for ensuring the manufacture of an electrophotographic developer that enables high-speed development with stable high-image quality even when employed in an MFP or the like as the electrophotographic development apparatus and in which the magnetic carrier has a long replacement interval. As a result, the inventors theorized that the hollow structure of the magnetic carrier alone was inadequate, and that there was a need for the carrier core material so satisfy the conditions $0.25 \leq A \leq 0.40$ where A is an apparent density/true density thereof, and an apparent density of 2.0 g/cm$^3$ or less. Thereupon, the inventors of the present invention theorized a method of manufacturing a carrier core material that satisfies these necessary conditions, and this led to the completion of the present invention.

That is to say, first means for resolving these problems constitutes:

an electrophotographic developer carrier core material which is a carrier core material employed in an electrophotographic developer carrier, wherein $0.25 \leq A \leq 0.40$ is satisfied where A is an apparent density/true density of the carrier core material, and also an apparent density is 2.0 g/cm$^3$ or less.

Second means thereof constitutes:

the electrophotographic developer carrier core material according to first means, wherein BET(0)≥0.07 m$^2$/g and 3.0≥BET(0)/BET(D)≤10.0 are satisfied where BET(0) expresses a value of a specific surface area of the carrier core material as measured by a BET method and BET(D) expresses a value of a sphere-converted specific surface area of the carrier core material obtained by dividing a cs value determined by a wet dispersion-type particle size distribution measurement apparatus by a true density.

Third means constitutes:

the electrophotographic developer carrier core material according to first and second means, wherein the carrier core material contains a magnetic oxide and a non-magnetic oxide having a true specific gravity of 3.5 or less.

Fourth means constitutes:

the electrophotographic developer carrier core material according to third means, wherein the magnetic oxide is a soft ferrite.

Fifth means constitutes:

the electrophotographic developer carrier core material according to third or fourth means, wherein the non-magnetic oxide is contained in an amount 1 wt % or more and 50 wt % or less of the carrier core material.

Sixth means constitutes:

an electrophotographic developer carrier, wherein the electrophotographic developer carrier core material according to any of first to fifth means is coated with a resin.

Seventh means constitutes:

the electrophotographic developer carrier according to sixth means, wherein the amount of coating of the resin is 0.1 wt % or more and 20.0 wt % or less of the carrier core material.

Eighth means constitutes:

the electrophotographic developer carrier according to sixth or seventh means, wherein an average particle size is 25 μm or more and 50 μm or less.

Ninth means constitutes:

the electrophotographic developer carrier according to any of sixth to eighth means, wherein 1 wt % or more and 50 wt % or less silica is contained.

Tenth means constitutes:

an electrophotographic developer, containing the electrophotographic developer carrier according to any of sixth to ninth means.

Eleventh means constitutes:

a method of manufacturing an electrophotographic developer carrier core material, having the steps of:

mixing one or two or more types selected from carbonates, oxides or hydroxides of one or two or more types of metal element M with $Fe_2O_3$ and pulverizing the same to a particle size of 1 μm to obtain a pulverized material;

adding resin particles, water, a binder and a dispersant to the pulverized material to form a slurry, and then wet pulverizing and drying the same to obtain a granulated powder;

calcining the granulated powder to obtain a calcined article;

sintering the calcined article to obtain a sintered material; and pulverizing the sintered material to obtain a carrier core material.

Twelfth means constitutes:

the method of manufacturing an electrophotographic developer carrier core material according to eleventh means, wherein silicon-containing resin particles are employed as the resin particles added to the pulverized material.

Thirteenth means constitutes:

a method of manufacturing an electrophotographic developer carrier core material, comprising the steps of:

mixing and pulverizing one or two or more types selected from carbonates, oxides or hydroxides of one or two or more types of metal element M with $Fe_2O_3$ to obtain a pulverized material;

adding silica particles, water, a binder and a dispersant to the pulverized material to form a slurry, and then wet pulverizing and drying the same to obtain a granulated powder;

sintering the granulated powder to obtain a sintered material; and pulverizing the sintered material to obtain a carrier core material.

The electrophotographic developer carrier manufactured employing the electrophotographic developer carrier core material according to any of first to fifth means constitutes an electrophotographic developer carrier that has a high tolerance to the stress to which it is subjected during mixing and agitation of the electrophotographic developer in an electrophotographic development apparatus, and that has a long replacement interval.

The electrophotographic developer carrier according to any of sixth to ninth means constitutes an electrophotographic developer carrier that has a high tolerance to the stress to which it is subjected during mixing and agitation of the electrophotographic developer in an electrophotographic development apparatus, and that has a long replacement interval.

The electrophotographic developer according to tenth means constitutes an electrophotographic developer that enables high-speed development with stable high-image quality even when employed in an MFP or the like, and that has a long replacement interval.

According to the methods of manufacturing an electrophotographic developer carrier core material according to any of eleventh to thirteenth means, it is possible to manufacture an electrophotographic developer carrier core material serving as an electrophotographic developer carrier starting material that has a high tolerance to the stress to which it is subjected during mixing and agitation of the electrophotographic developer in an electrophotographic development apparatus, and that has a long replacement interval.

BEST MODE FOR CARRYING OUT THE INVENTION

Working examples of the present invention will be hereinafter described.

The carrier core material pertaining to the present invention satisfies $0.25 \leq A \leq 0.40$ where A is an apparent density/true density of the carrier core material at room temperature, and has an apparent density of 2.0 g/cm$^3$ or less. Here, the apparent density is preferably measured in accordance with, for example, JISZ2504. A true density measurement apparatus (for example, a later-described pycnometer) is a convenient means for measuring the true density.

The electrophotographic developer manufactured employing the magnetic carrier containing the carrier core material of this configuration exhibits the superior characteristics of enabling high-speed development with stable high-image quality even when employed in an MFP or the like, and a long magnetic carrier replacement interval.

While the specific reasons why the electrophotographic developer exhibits the above-described superior characteristics as a result of the employment of this carrier core material are unclear, it is thought that due to the abovementioned A lying in a predetermined range, the agitation torque at which the electrophotographic developer is agitated in an electrophotographic development apparatus such as an MFP or the like is reduced to enable high-speed development with stable high-image quality, and also the impact on the magnetic carrier is reduced and the damage thereof is decreased, thereby the magnetic carrier replacement interval can be increased.

Furthermore, another reason is that if $BET(0) \geq 0.07$ m$^2$/g and $3.0 \leq BET(0)/BET(D) \leq 10.0$ are satisfied where BET(0) expresses a value of a specific surface area as measured by a BET method and BET(D) expresses a value of a sphere-converted specific surface area of the carrier core material pertaining to the present invention, the hollow structure in the carrier core material is formed as an aggregate of very fine hollow structure, and moreover a sufficient amount of hollow structure is formed. Here, the BET(0) which is a value of a specific surface area as measured by a BET method means a value of a specific surface area as measured by a normal BET method. On the other hand, the BET(D) which is a value of a sphere-converted specific surface area is calculated by determining a cs value (Calculated Specific Surfaces Area) using, for example, a Microtrac which constitutes a wet dispersion-type particle size distribution measurement apparatus, and by dividing this cs value by the abovementioned true density. The hollow structure of the carrier core material of this configuration is an aggregate of a very fine hollow structure and, accordingly, it is mechanically robust. The increase in the magnetic carrier replacement interval is thought to occur because, as a result, the magnetic carrier comprising this carrier core material has impact tolerance.

The application of the electrophotographic developer manufactured employing the magnetic carrier of the above-described configuration in an MFP or the like exhibits the characteristics of enabling high-speed development with a stable high-image quality, and a replacement interval at least 50% longer than a conventional product.

Furthermore, it is preferable that the configuration adopted for the carrier core material pertaining to the present invention comprises a compound structure of a magnetic oxide and a non-magnetic oxide having a true specific gravity of 3.5 g/cm$^3$ or less. As a result of the adoption of this configuration, and embedding of a non-magnetic oxide in the hollow portion there, the volume of the hollow structure can be decreased while maintaining the above-described A or BET(0)/BET(D) values in a predetermined range, and the mechanical strength of the carrier core material can be improved. Here, preferred examples of a non-magnetic oxide having a true specific gravity of 3.5 g/cm$^3$ or less include $SiO_2$, $Al_2O_3$, $Al(OH)_2$ and $B_2O_3$. A quantity of non-magnetic oxide contained in the carrier core material of preferably 1 wt % or more and 50 wt % or less, and more preferably 5 wt % or more and 40 wt % or less constitutes a preferred configuration in terms of the compatibility of the magnetic and mechanical properties of the carrier core material. Examples of the magnetic oxide include Spinel-type ferrites (Mn, Mg, Fe, Co, Ni, Cu, Zn or the like as $M^{2+}$) expressed by the general formulae $M^{2+}O.Fe_2O_3$ or $M^{2+}.Fe_2O_4$, Magnetoplumbite-type ferrites (Ba, Sr, Pb or the like as $M^{2+}$) expressed by the general formulae $M^{2+}O.6Fe_2O_3$ or $M^{2+}.Fe_{12}O_{19}$, Garnet-type ferrites (Sm, Eu, Gd, Tb, Dy, Ho, Er, Tm, Yb, Lu or the like as $M^{3+}$) expressed by the general formula $3M^{3+}{}_2O_3.5Fe_2O_3$ or $M^{3+}{}_3Fe_5O_{12}$, and Perovskite-type ferrites and Ilmenite-type ferrites, the employment of a so-called soft ferrite of a known Spinel-type ferrite $M^{2+}O.Fe_2O_3$ comprising as the $M^{2+}$ at least one type of Mn, Mg, Fe being particularly preferred. This is because the employment of a soft ferrite is advantageous from the viewpoint of agitatability of the toner and the carrier, and from the viewpoint of producing an image of high-image quality.

Next, by coating the above-described carrier core material with a resin, a magnetic carrier can be obtained. An example of a preferably employed coated resin is a silicon resin. The preferred mechanical properties and tolerance can be exhibited by the magnetic carrier if the quantity of the coating is 0.1 wt % or more of the carrier core material, and a state of magnetic carrier agglomeration can be avoided if the quantity of this coating is 20.0 wt % or less of the carrier core material and, furthermore, the more preferred quantity of coating in terms of avoiding a state in which the resistance of the carrier is excessive is 12 wt % or less of the carrier core material.

An electrophotographic developer can be manufactured by mixing the magnetic carrier of the above-noted configuration with a toner of particle diameter of the order of 10 μm manufactured by a pulverizing method or a polymerization method. This electrophotographic developer exhibits the characteristics of enabling high-speed development with a stable high-image quality even when employed in an MFP or the like, and a replacement interval at least 50% longer than a conventional product.

Two methods for the manufacture of the carrier core material and the magnetic carrier containing the carrier core material pertaining to the present invention of: 1. Method of resin addition; and 2. Method of silica particle addition will be hereinafter described.

1. Method of Resin Addition

[Weighing·Mixing]

The magnetic oxide employed in the carrier core material contained by the magnetic carrier pertaining to the present invention (preferably a soft ferrite) is expressed by the general formula: $MO.Fe_2O_3$. The M referred to here denotes a metal such as Fe, Mn or Mg. While the Fe, Mn and Mg are independently usable, from the viewpoint of broadening the range in which the magnetic properties of the carrier core material are controllable, a mixed composition thereof is preferably.

For Fe as the M starting material, $Fe_2O_3$ is ideally used. While for Mn as the starting material $MnCO_3$ is ideally used, this is not limited thereto and $MN_3O_4$ or the like can also be used, and while for Mg as the starting material $MgCO_3$ is ideally used, this is not limited thereto and $Mg(OH)_2$ or the like can also be used. These starting materials are weighed and mixed to obtain the metal starting material mixture so that the compounding ratio thereof corresponds with the target composition of the magnetic oxide.

Next, resin particles are added to the metal starting material mixture. Thereupon, a configuration to which carbon-based resin particles of polyethylene, acryl or the like are added and a configuration to which resin particles containing silicon such as a silicon resin are added is produced. The carbon-based resin particles and the silicon-containing resin particles are equivalent in that, in a later-described calcination step, they are combusted and a hollow structure is generated in a calcining powder by the gas generated during this combustion. However, while subsequent to being combusted the carbon-based resin particles generate a hollow structure in a calcining powder alone, subsequent to being combusted the silicon-containing resin particles form $SiO_2$ that is residual in the generated hollow structure. For both the carbon-based and the silicon-based resin particles, the average particle size is preferably 2 μm to 8 μm, and the added amount is preferably 0.1 wt % or more and 20 wt % or less, and more preferably 12 wt % of the total starting material powder.

[Pulverization·Granulation]

A weighed and mixed metal starting material mixture of M and Fe or the like and the resin particles is introduced into a pulverizer such as a vibration mill and pulverized to a particle diameter of 2 μm to 0.5 μm, and preferably to a particle diameter of 1 μm. Next, as a result of the addition to the pulverized material of water, 0.5 to 2 wt % of binder, and 0.5 to 2 wt % dispersant, a slurry of solid fraction density 50 to 90 wt % is formed, and the slurry is wet pulverized in a ball mill or the like. Here, as the binder, polyvinyl alcohol or the like is preferred, and as the dispersant, an ammonium polycarboxylate-based dispersant is preferred.

In the granulation step, the wet pulverized slurry is introduced into a spray dryer and spray dried at a temperature of 100° C. to 300° C. in a hot air blast to obtain a granulated powder of particle diameter 10 μm to 200 μm. The particle size of the thus-obtained granulated powder is regulated with consideration to the particle diameter of the final manufactured product by removal of the coarse particles and the fine powder outside this range using a vibrating screen. While the specific reasons thereof will be described later, the particle diameter of the final manufactured product is preferably 25 μm or more and 50 μm or less and, accordingly, the particle diameter of the granulated powder is preferably regulated to 15 μm to 100 μm.

[Calcination]

The mixed granulated material of the metal starting material mixture and the resin particles is introduced into a furnace heated to between 800° C. and 1000° C., and calcined in an air atmosphere to produce a calcined article. A hollow structure is formed in the granulated powder at this time from the gas generated as a result of the combustion of the resin particles. When silicon-containing resin particles are employed as the resin, a non-magnetic oxide $SiO_2$ is created in the hollow structure.

[Sintering]

Next, the calcined article in which the hollow structure is formed is introduced into a furnace heated to between 1100° C. and 1250° C. and sintered to form a ferrite sintered material. The atmosphere employed for the sintering is selected as appropriate in accordance with the type of metal starting material. For example, for Fe Mn metal starting materials (mole ratio 100:0 to 50:50), a nitrogen atmosphere is employed, while for Fe, Mn, Mg a nitrogen atmosphere or an oxygen partial pressure-regulated atmosphere is preferred, and for Fe, Mn, Mg in which the Mg mole ratio exceeds 30%, and air atmosphere may be employed.

[Pulverization, Classification]

The thus-obtained sintered material is subjected to coarse pulverization by hammer mill particle dispersion or the like, and then primary classified in an airflow classifier. Furthermore, subsequent to the particle sizes being made uniform using a vibrating screen or an ultrasonic screen, the material is placed in a magnetic field separator and the non-magnetized component removed to produce a carrier core material.

[Coating]

A resin coating is administered on the thus-obtained carrier core material to manufacture a magnetic carrier. As the coating resin, a silicon-based resin such as KR251 (Manufactured by Shin-Etsu Chemicals Co., Ltd.) is preferred. 20 to 40 wt % of the coating resin is dissolved in an appropriate solvent (toluene or the like) to prepare a resin solution. The resin material to be coated on the carrier core material can be controlled by the resin solution concentration. The thus-prepared resin solution and carrier core material are mixed in a weight ratio of carrier core material:resin solution=10:1 to 5:1, then thermally agitated at 150° C. to 250° C. to obtain a resin-coated carrier core material. Here, the amount of coated resin is preferably 0.1 wt % or more and 20.0 wt % or less of the abovementioned carrier core material.

By further heating this resin-coated carrier core material to cure the coated resin layer, a magnetic carrier, which constitutes a carrier core material on which this coating resin is coated, can be manufactured.

Here, the final particle diameter of the magnetic carrier is preferably 25 μm or more and 50 μm or less. A particle diameter of 25 μm or more is preferable from the viewpoint of reducing adhesion of the carrier and improving the image quality, and a particle diameter of 50 μm or less is preferable from the viewpoint of improving the toner holding potential of the carrier particles, improving the solid image uniformity, decreasing the amount of scattered toner, and reducing fogging.

Furthermore, by mixing the magnetic carrier with a toner of appropriate particle diameter, an electrophotographic developer can be manufactured.

2. Method of Silica Particle Addition

[Weighing·Mixing]

The magnetic oxide (preferably a soft ferrite) employed in the carrier core material contained by the magnetic carrier pertaining to the present invention is mixed in the same way as described above in 1. Method of resin addition using the same starting materials thereof to obtain a metal starting material mixture.

Next, silica particles are added to the metal starting material mixture. Here, while different to the resin particles described in 1. Method of resin addition, the silica particles do not generate a gas upon combustion, they are incorporated in a later-described sintering step into a ferrite sintered material. Thereupon, the sintered material in which these silica particles have been incorporated comprises a structure that resembles the structure of the "sintered material in which the $SiO_2$ is residual in the hollow structure" as described in 1. Method of resin addition. Here, as a result of examinations carried out by the inventors of the present invention, it was theorized that if the average particle size of the silica particles is 1 μm to 10 μm, and the added amount thereof is 1 wt % to 50 wt % of the total starting material powders, a carrier core material in which $0.25 \leq A \leq 0.40$ is satisfied where A is an apparent density/true density of the carrier core material and also apparent density is 2.0 g/cm$^3$ or less is obtained in a later step, and furthermore that there are no undesirable effects imparted to an electrophotographic developed image produced using an electrophotographic developer manufactured employing this carrier core material.

[Pulverization·Granulation]

A weighed and mixed metal starting material mixture of M and Fe or the like and the resin particles are introduced into a pulverizer such as a vibration mill or the like and pulverized, formed as a slurry and wet pulverized, and then granulated to obtain a granulated powder of particle diameter 10 μm to 200 μm in the same way as described for 1. Method of resin addition. As is described in 1. Method of resin addition, in this method of manufacture as well the final particle diameter of the manufactured product is preferably 25 μm or more and 50 μm or less and, accordingly, the granulated powder particle diameter is regulated to between 15 μm and 100 μm.

[Calcination]

The calcination step of the mixture granulated material of the metal starting material mixture and silica particles is omitted, and the subsequently administered step is a sintering step.

[Sintering]

Next, the mixture granulated material of the metal starting material mixture and the silica particles is introduced into a furnace heated to between 1100° C. and 1250° C. and sintered to form a ferrite sintered material. The atmosphere during sintering is the same as described for 1. Method of resin addition. As a result of this sintering, a sintered material in which silica particles have been incorporated is created.

[Pulverization, Classification]

The thus-obtained sintered material is pulverized and classified in the same way as described for 1. Method of resin addition to form a carrier core material.

[Coating]

In the same way as described for 1. Method of resin addition, a resin coating is administered on the thus-obtained carrier core material and the coated resin layer cured to manufacture a magnetic carrier.

Furthermore, the magnetic carrier is mixed with a toner of appropriate particle diameter to manufactured an electrophotographic developer.

While the manufacture of a magnetic carrier based on the two methods of: 1. Method of resin addition; and 2. Method of silica particle addition is described above, the silica fraction contained in the magnetic carrier subsequent to the addition of a silicon resin or silica particles is 1 wt % or more and 50 wt % or less. As a result, a low porosity density carrier in which the carrier core material contained in the magnetic carrier satisfies the requirements of $0.25 \leq A \leq 0.40$ where A=an apparent density/true density and an apparent density of 2.0 g/cm$^3$ or less can be obtained.

WORKING EXAMPLES

The present invention will be hereinafter more specifically described with reference to the Working Examples thereof.

Working Example 1

Finely pulverized $Fe_2O_3$ and $MgCO_3$ were prepared as carrier core material starting materials. The starting materials were weighed to establish a mole ratio of $Fe_2O_3$:MgO=80:20. Meanwhile, a product obtained by adding polyethylene resin particles (LE-1080, Manufactured by Sumitomo Seika Co., Ltd.) of average particle size 5 μm in an amount equivalent to 10 wt % of the total starting materials, 1.5 wt % ammonium polycarboxylate-based dispersant as a dispersant, 0.05 wt % SN Wet980 Sannopco (Co. Ltd.) as a wetting agent, and 0.02 wt % polyvinyl alcohol as a binder to water was prepared and introduced to and agitated with the weighed $Fe_2O_3$, $MgCO_3$ of the previous step to obtain a 75 wt % slurry concentration. The slurry was wet-pulverized using a wet ball mill and agitated for a short time, after which the slurry was sprayed using a spray dryer to manufacture a dried granulated article of particle diameter 10 μm to 200 μm. A sieve of mesh size 61 μm was employed to separate the coarse particles from the granulated article that was then calcined by heating in a 900° C. atmosphere to decompose the resin particle component. This was then sintered for 5 hrs at 1160° C. in a nitrogen atmosphere to form a ferrite. The thus-formed ferrite sintered article was pulverized in a hammer mill, an air swept classifier was employed to remove the fine powder therefrom, and the particle size was regulated using a vibrating screen of mesh size 54 μm to obtain the carrier core material.

Next, a coating resin solution was prepared by dissolving a silicon-based resin (Product Name: KR 251, Manufactured by Shin-Etsu Chemical Co., Ltd.) in toluene. The abovementioned carrier core material and the resin solution were introduced into an agitator in a weight ratio of carrier core material:resin solution=9:1, and the carrier core material was thermally agitated at 150° C. to 250° C. while immersed in the resin solution for 3 hrs. As a result, the resin was coated onto the carrier core material in a ratio of 1.0 wt % to the weight thereof. This resin-coated carrier core material was set in a hot air blast circulating-type heating apparatus and heated for 5 hrs at 250° C. to cure the coated resin layer and, as a result, to obtain a magnetic carrier of Working Example 1.

Working Example 2

Apart from the addition of the polyethylene resin particles in an amount 0.1 wt % of the total starting materials, the magnetic carrier of Working Example 2 was obtained in the same way as the magnetic carrier of working Example 1.

Working Example 3

Apart from the addition of the polyethylene resin particles in an amount 20 wt % of the total starting materials, the magnetic carrier of Working Example 3 was obtained in the same way as the magnetic carrier of Working Example 1.

Working Example 4

Apart from the addition of $MnCO_3$ as a carrier core material starting material in addition to the finely pulverized $Fe_2O_3$ and $MgCO_3$, and weighing the starting materials being weighed to establish a mole ratio of $Fe_2O_3$:MnO:MgO=52:34:14, the magnetic carrier of Working Example 4 was obtained in the same way as the magnetic carrier of Working Example 1.

Working Example 5

Apart from the alteration of the polyethylene resin particles to silicon resin particles of average particle size 2.4 μm which constitutes a silicon-containing resin (Tospearl 120, Manufactured by GE Toshiba Silicon Co. Ltd.), and sintering being implemented at a sintering temperature of 1200° C., the magnetic carrier of Working Example 5 was obtained in the same way as the magnetic carrier of Working Example 2.

Working Example 6

Apart from the omission of $MgCO_3$ and the addition of the finely pulverized $Fe_2O_3$ and $MnCO_3$ as the carrier core material starting materials, the starting materials being weighed to establish a mole ratio of $Fe_2O_3$:MnO=65:35, and sintering being implemented at a sintering temperature of 1160° C., the magnetic carrier of Working Example 6 was obtained in the same way as the magnetic carrier of Working Example 5.

Working Example 7

Apart from the alteration of the polyethylene resin particles to silicon resin particles of average particle size 2.4 μm which constitutes a silicon-containing resin (Tospearl 120, Manufactured by GE Toshiba Silicon Co. Ltd.), and sintering being implemented at a sintering temperature of 1180° C., the magnetic carrier of Working Example 7 was obtained in the same way as the magnetic carrier of Working Example 4.

Working Example 8

Apart from the omission of $MgCO_3$ and the addition of the finely pulverized $Fe_2O_3$ and $Mn_3O_4$ as the carrier core material starting materials, the starting materials being weighed to establish a mole ratio of $Fe_2O_3$:MnO=65:35, and sintering being implemented at a sintering temperature of 1130° C., the magnetic carrier of Working Example 8 was obtained in the same way as the magnetic carrier of Working Example 3.

Working Example 9

Apart from the alteration of the polyethylene resin particles to silicon resin particles of average particle size 2.4 μm which constitutes a silicon-containing resin (Tospearl 120, Manufactured by GE Toshiba Silicon Co. Ltd.), and sintering being implemented at a sintering temperature of 1160° C., the magnetic carrier of Working Example 9 was obtained in the same way as the magnetic carrier of Working Example 8.

Working Example 10

Apart from the addition of $Mg(OH)_2$ as a carrier core material starting material in addition to the finely pulverized $Fe_2O_3$ and $Mn_3O_4$, the starting materials being weighed to establish a mole ratio of $Fe_2O_3$:MnO:MgO=52:34:14, and these starting materials being sintered at a sintering temperature of 1180° C., the magnetic carrier of Working Example 10 was obtained in the same way as the magnetic carrier of Working Example 9.

Working Example 11

Finely pulverized $Fe_2O_3$ and $Mg(OH)_2$ were prepared as carrier core material starting materials. The starting materials were weighed to establish a mole ratio of $Fe_2O_3$:MgO=80:20. Meanwhile, a product obtained by adding silica particles (SIKRON M500, Manufactured by SIBELCO) of average particle size 4 μm in an amount equivalent to 20 wt % of the total starting materials, 1.5 wt % ammonium polycarboxylate-based dispersant as a dispersant, 0.05 wt % SN Wet980 Sannopco (Co. Ltd.) as a wetting agent, and 0.02 wt % polyvinyl alcohol as a binder to water was prepared and introduced to and agitated with the weighed $Fe_2O_3$, $Mg(OH)_2$ of the previous step to obtain a 75 wt % slurry concentration. The slurry was wet-pulverized using a wet ball mill and agitated for a short time, after which the slurry was sprayed using a spray dryer to manufacture a dried granulated article of particle diameter 10 μm to 200 μm. A sieve of mesh size 25 μm was employed to separate the coarse particles from the granulated article which was then sintered for 5 hrs at 1150° C. in a nitrogen atmosphere to form a ferrite. The thus-formed ferrite sintered article was pulverized in a hammer mill, an air swept classifier was employed to remove the fine powder therefrom, and the particle size regulated using a vibrating screen of mesh size 54 μm to obtain the carrier core material.

Next, a silicon-based resin was coated and cured on the carrier core material in the same way as for Working Example 1 to obtain a magnetic carrier of Working Example 11.

Working Example 12

Apart from the omission of $Mg(OH)_2$ and the addition of a finely pulverized $Mn_3O_4$ as a carrier core material starting material, and the starting materials being weighed to establish a mole ratio of $Fe_2O_3$:MnO=80:20, the magnetic carrier of Working Example 12 was obtained in the same way as the magnetic carrier of Working Example 11.

Working Example 13

Apart from the addition of the silica particles in an amount 40 wt % of the total amount of starting materials, the magnetic carrier of Working Example 13 was obtained in the same way as the magnetic carrier of Working Example 12.

Working Example 14

Apart from the alteration of the sintering temperature to 1110° C., the magnetic carrier of Working Example 14 was obtained in the same way as the magnetic carrier of Working Example 11.

Working Example 15

Apart from the alteration of the sintering temperature to 1140° C., the magnetic carrier of Working Example 15 was obtained in the same way as the magnetic carrier of Working Example 11.

Working Example 16

Apart from the substitution of $Mg(OH)_2$ with $MgCO_3$ and the alteration of the sintering temperature to 1170° C., the magnetic carrier of Working Example 16 was obtained in the same way as the magnetic carrier of Working Example 11.

Working Example 17

Apart from the omission of $Mg(OH)_2$ as a carrier core material starting material and the addition of a finely pulverized $Mn_3O_4$, the starting materials being weighed to establish a mole ratio of $Fe_2O_3$:MnO=57:43, the silica particles being added in an amount 5 wt % of the total amount of starting materials, and the sintering temperature being altered to 1100° C., the magnetic carrier of Working Example 17 was obtained in the same way as the magnetic carrier of Working Example 11.

Working Example 18

Apart from the addition of the silica particles in an amount 10 wt % of the total amount of starting materials, and the sintering temperature being altered to 1070° C., the magnetic carrier of Working Example 18 was obtained in the same way as the magnetic carrier of Working Example 17.

Working Example 19

Apart from the addition of the silica particles in an amount 20 wt % of the total amount of starting materials, and the sintering temperature being altered to 1170° C., the magnetic carrier of Working Example 19 was obtained in the same way as the magnetic carrier of Working Example 17.

Working Example 20

Apart from the addition of the silica particles in an amount 40 wt % of the total amount of starting materials, and the sintering temperature being altered to 1140° C., the magnetic carrier of Working Example 20 was obtained in the same way as the magnetic carrier of Working Example 17.

Working Example 21

Apart from the addition of the silica particles in an amount 60 wt % of the total amount of starting materials, and the sintering temperature being altered to 1130° C., the magnetic carrier of Working Example 20 was obtained in the same way as the magnetic carrier of Working Example 17.

Comparative Example 1

Apart from the non-addition of the polyethylene resin particles and the absence of the calcination step, the magnetic carrier of Comparative Example 1 was obtained in the same way as the magnetic carrier of Working Example 1.

Comparative Example 2

Apart from the finely pulverized $Fe_2O_3$ and $MgCO_3$ serving as the starting materials being weighed to establish a mole ratio of $Fe_2O_3$:MgO=75:25, the magnetic carrier of Comparative Example 2 was obtained in the same way as the magnetic carrier of Comparative Example 1.

Comparative Example 3

Apart from the non-addition of the polyethylene resin particles and the absence of the calcination step, the magnetic carrier of Comparative Example 3 was obtained in the same way as the magnetic carrier of Working Example 4.

Comparative Example 4

Apart from the non-addition of the polyethylene resin particles, the magnetic carrier of Comparative Example 4 was obtained in the same way as the magnetic carrier of Working Example 4.

Comparative Example 5

Apart from the non-addition of the silicon resin particles, the magnetic carrier of Comparative Example 5 was obtained in the same way as the magnetic carrier of Working Example 10.

Comparative Example 6

Apart from the non-addition of the silicon resin particles, the absence of the calcination step, and the alteration of the sintering temperature to 1160° C., the magnetic carrier of Comparative Example 6 was obtained in the same way as the magnetic carrier of Working Example 9.

Summary of Working Examples 1 to 21 and Comparative Examples 1 to 6

Table 1 shows a list of the manufacturing conditions of the above-noted Working Examples and Comparative Examples, and Table 2 shows a list of the physical values of the manufactured carrier core materials.

The measurement of apparent density was implemented in accordance with JIS-Z2504:2000. The measurement of true density was carried out employing a Pycnometer 1000 manufactured by QUANTA CHROME Co., Ltd. The specific surface area BET(0) was measured employing a SORB U2 manufactured by Yuasa Ionics Co., Ltd. The measurement of the sphere-converted specific surface area BET(D) was based initially on the employment of a Microtrac HRA manufactured by Nikkiso (Co. Ltd.) to measure a cs value (calculated specific surfaces area), and this cs value being then divided by the true density. Table 2 shows the BET(0)/BET(D) value as an index B. The average particle size was measured using a Microtrac HRA manufactured by Nikkiso (Co. Ltd.). Saturation magnetization and holding force were measured using a room temperature-specific Vibrating Sample Magnetometer (VSM) (Manufactured by the Toei Industry Co. Ltd.). The non-magnetic fraction (silica) was measured by a method conducted in accordance with the JIS Standard (JIS G 1212).

Furthermore, the magnetic carriers of the Working Examples and Comparative Examples were mixed with a commercially available toner of particle diameter of the order of 1 μm to manufacture an electrophotographic developer, and image evaluation testing was conducted employing these electrophotographic developers. Table 3 shows the results thereof. ◎ denotes a very high level, ○ denotes a good level, Δ denotes a usable level, and x denotes a non-usable level in this evaluation.

While it can be said from Table 2 that the lower the index A the greater the extent to which the density of the carrier core material can be decreased, because the actual specific surface area is greater than the specific surface area calculated from the apparent particle diameter if the index B is 3.0 or greater, a very fine hollow structure can be said to have been formed in the carrier interior and when 10 or less, an adequate amount of hollow structure can be said to have been formed. Accordingly, it is clear that because the values of the index A of the Working Examples 1 to 10 are comparatively lower than those of Comparative Examples 1 to 6, the carrier core material density can be decreased overcoming the differences in starting material composition. In addition, it is apparent the values of the index B of the Working Examples 1 to 21 lie in a comparatively preferred range to those of the Comparative Examples 1 to 6, and that an adequate very fine hollow structure is formed in the interior of the carrier core material overcoming the differences in starting material composition.

Furthermore, as a result of the Si component of the silicon resin forming $SiO_2$ particles during calcination and the $SiO_2$ particles being compounded to form a ferrite composition because of the addition of silicon resin particles in Working Examples 5 to 7, 9 and 10, a carrier core material of even lower true specific gravity can be manufactured. In addition, as a result of the silica particles being incorporated and compounded in a ferrite composition in Working Examples 11 to 21, a carrier core material of even lower specific gravity can be manufactured in these Working Examples as well.

The following is apparent from the image evaluation test results shown in Table 3.

First, excluding the image quality of Comparative Example 1, the initial-state image characteristics of each of the Working Examples and the Comparative Examples was either a good or a very good level. While for each of the Working Examples a very good or good level was maintained even after 50,000 copies, a drop in level was observed to have begun at this stage in Comparative Examples 1 to 6. While for some of the Working Examples a drop in level was observed after 100,000 copies, it was apparent that an unusable level of all items of the Comparative Examples 1 to 6 had been reached at this stage, and that the period for the replacement thereof had elapsed. Furthermore, while none of the Working Examples 1 to 21 were of an unusable level after 150,000 copies, it was apparent that all of the Comparative Examples 1 to 6 were an unusable level.

TABLE 1

| | STARTING MATERIAL SELECTION | | | | COMPOUNDING RATIO | | | | CALCINATION/SINTERING CONDITIONS | |
|---|---|---|---|---|---|---|---|---|---|---|
| | Fe STARTING MATERIAL | Mn STARTING MATERIAL | Mg STARTING MATERIAL | RESIN PARTICLES OR SILICA PARTICLES | $Fe_2O_3$ (MOL RATIO) | MnO (MOL RATIO) | MgO (MOL RATIO) | RESIN OR SILICA (WEIGHT RATIO) | CALCINATION TEMPERATURE (° C.) | SINTERING TEMPERATURE (° C.) |
| Working Example 1 | $Fe_2O_3$ | — | $M_gCO_3$ | POLYETHYLENE | 80 | — | 20 | 10 | 900 | 1160 |
| Working Example 2 | $Fe_2O_3$ | — | $M_gCO_3$ | POLYETHYLENE | 80 | — | 20 | 0.1 | 900 | 1160 |
| Working Example 3 | $Fe_2O_3$ | — | $M_gCO_3$ | POLYETHYLENE | 80 | — | 20 | 20 | 900 | 1160 |
| Working Example 4 | $Fe_2O_3$ | $MnCO_3$ | $M_gCO_3$ | POLYETHYLENE | 52 | 34 | 14 | 0.1 | 900 | 1160 |
| Working Example 5 | $Fe_2O_3$ | — | $M_gCO_3$ | SILICON RESIN | 80 | — | 20 | 0.1 | 900 | 1200 |
| Working Example 6 | $Fe_2O_3$ | $MnCO_3$ | — | SILICON RESIN | 65 | 35 | — | 0.1 | 900 | 1160 |
| Working Example 7 | $Fe_2O_3$ | $MnCO_3$ | $M_gCO_3$ | SILICON RESIN | 52 | 34 | 14 | 0.1 | 900 | 1180 |
| Working Example 8 | $Fe_2O_3$ | $Mn_3O_4$ | — | POLYETHYLENE | 65 | 35 | — | 20 | 900 | 1130 |
| Working Example 9 | $Fe_2O_3$ | $Mn_3O_4$ | — | SILICON RESIN | 65 | 35 | — | 20 | 900 | 1160 |
| Working Example 10 | $Fe_2O_3$ | $Mn_3O_4$ | $Mg(OH)_2$ | SILICON RESIN | 52 | 34 | 14 | 20 | 900 | 1180 |
| Working Example 11 | $Fe_2O_3$ | — | $Mg(OH)_2$ | SILICA PARTICLES | 80 | 0 | 20 | 20 | NOT CALCINED | 1150 |
| Working Example 12 | $Fe_2O_3$ | $Mn_3O_4$ | — | SILICA PARTICLES | 80 | 20 | 0 | 20 | NOT CALCINED | 1150 |
| Working Example 13 | $Fe_2O_3$ | $Mn_3O_4$ | — | SILICA PARTICLES | 80 | 20 | 0 | 40 | NOT CALCINED | 1150 |
| Working Example 14 | $Fe_2O_3$ | — | $Mg(OH)_2$ | SILICA PARTICLES | 80 | — | 20 | 20 | NOT CALCINED | 1110 |
| Working Example 15 | $Fe_2O_3$ | — | $Mg(OH)_2$ | SILICA PARTICLES | 80 | — | 20 | 20 | NOT CALCINED | 1140 |
| Working Example 16 | $Fe_2O_3$ | — | $MgCO_3$ | SILICA PARTICLES | 80 | — | 20 | 20 | NOT CALCINED | 1170 |
| Working Example 17 | $Fe_2O_3$ | $Mn_3O_4$ | — | SILICA PARTICLES | 57 | 43 | — | 5 | NOT CALCINED | 1100 |
| Working Example 18 | $Fe_2O_3$ | $Mn_3O_4$ | — | SILICA PARTICLES | 57 | 43 | — | 10 | NOT CALCINED | 1070 |
| Working Example 19 | $Fe_2O_3$ | $Mn_3O_4$ | — | SILICA PARTICLES | 57 | 43 | — | 20 | NOT CALCINED | 1170 |
| Working Example 20 | $Fe_2O_3$ | $Mn_3O_4$ | — | SILICA PARTICLES | 57 | 43 | — | 40 | NOT CALCINED | 1140 |
| Working Example 21 | $Fe_2O_3$ | $Mn_3O_4$ | — | SILICA PARTICLES | 57 | 43 | — | 60 | NOT CALCINED | 1130 |
| Comparative Example 1 | $Fe_2O_3$ | — | $MgCO_3$ | NOT ADDED | 80 | — | 20 | — | NOT CALCINED | 1160 |
| Comparative Example 2 | $Fe_2O_3$ | — | $MgCO_3$ | NOT ADDED | 75 | — | 25 | — | NOT CALCINED | 1160 |
| Comparative Example 3 | $Fe_2O_3$ | $MnCO_3$ | $MgCO_3$ | NOT ADDED | 52 | 34 | 14 | — | NOT CALCINED | 1160 |
| Comparative Example 4 | $Fe_2O_3$ | $MnCO_3$ | $MgCO_3$ | NOT ADDED | 52 | 34 | 14 | — | 900 | 1160 |
| Comparative Example 5 | $Fe_2O_3$ | $Mn_3O_4$ | $Mg(OH)_2$ | NOT ADDED | 52 | 34 | 14 | — | 900 | 1180 |
| Comparative Example 6 | $Fe_2O_3$ | $Mn_3O_4$ | — | NOT ADDED | 65 | 35 | — | — | NOT CALCINED | 1130 |

TABLE 2

| | APPARENT DENSITY ($g/cm^2$) | TRUE DEN-SITY ($g/cm^2$) | INDEX A | BET (O) ($m^2/g$) | BET (D) ($m^2/g$) | INDEX B | AVERAGE PARTICLE SIZE (μm) | cs VALUE ($m^2/cm^2$) | SATURIZATION MAGNET-IZATION (amu/g) | HOLD-ING FORCE (Cn) | COATED RESIN AMOUNT (wt %) | NON-MAGNETIC FRACTION SILICA (wt %) |
|---|---|---|---|---|---|---|---|---|---|---|---|---|
| Working Example 1 | 1.68 | 4.95 | 0.34 | 0.220 | 0.029 | 7.62 | 45.1 | 0.143 | 62.5 | 14.3 | 1.0 | 0.0 |
| Working Example 2 | 1.93 | 4.97 | 0.39 | 0.100 | 0.026 | 3.85 | 44.5 | 0.129 | 64.4 | 8.2 | 1.0 | 0.0 |
| Working Example 3 | 1.43 | 4.93 | 0.29 | 0.193 | 0.034 | 5.76 | 43.6 | 0.165 | 60.5 | 22.5 | 1.0 | 0.0 |
| Working Example 4 | 1.81 | 4.91 | 0.37 | 0.176 | 0.037 | 4.69 | 40.3 | 0.184 | 65.2 | 7.6 | 1.0 | 0.0 |
| Working Example 5 | 1.77 | 4.82 | 0.37 | 0.187 | 0.037 | 5.07 | 41.9 | 0.178 | 63.2 | 8.4 | 1.0 | 1.3 |
| Working Example 6 | 1.86 | 4.92 | 0.38 | 0.214 | 0.039 | 5.45 | 37.2 | 0.193 | 82.6 | 7.9 | 1.0 | 1.8 |
| Working Example 7 | 1.83 | 4.83 | 0.38 | 0.233 | 0.039 | 5.93 | 39.7 | 0.190 | 65.1 | 9.1 | 1.0 | 1.6 |
| Working Example 8 | 1.59 | 4.92 | 0.32 | 0.135 | 0.039 | 3.46 | 36.1 | 0.192 | 65.2 | 23.8 | 1.0 | 0.0 |
| Working Example 9 | 1.33 | 4.18 | 0.32 | 0.389 | 0.043 | 9.02 | 35.5 | 0.180 | 72.5 | 27.5 | 1.0 | 3.4 |
| Working Example 10 | 1.33 | 4.15 | 0.32 | 0.250 | 0.043 | 5.83 | 38.5 | 0.178 | 60.3 | 21.5 | 1.0 | 4.9 |
| Working Example 11 | 1.56 | 4.45 | 0.35 | 0.113 | 0.030 | 3.75 | 40.9 | 0.134 | 62.8 | 43.5 | 1.0 | 15.8 |
| Working Example 12 | 1.73 | 4.52 | 0.38 | 0.096 | 0.034 | 2.85 | 41.2 | 0.152 | 60.4 | 16.2 | 1.0 | 15.9 |
| Working Example 13 | 1.44 | 4.01 | 0.36 | 0.123 | 0.043 | 2.85 | 40.5 | 0.173 | 62.8 | 24.4 | 1.0 | 27.0 |
| Working Example 14 | 1.68 | 4.33 | 0.39 | 0.192 | 0.039 | 4.92 | 35.9 | 0.169 | 62.5 | 51.0 | 12.0 | 15.7 |
| Working Example 15 | 1.39 | 4.32 | 0.32 | 0.401 | 0.041 | 9.87 | 34.5 | 0.176 | 63.3 | 52.8 | 12.0 | 16.0 |
| Working Example 16 | 1.56 | 4.33 | 0.36 | 0.275 | 0.035 | 7.89 | 35.2 | 0.151 | 62.8 | 47.1 | 12.0 | 15.6 |
| Working Example 17 | 1.80 | 4.80 | 0.38 | 0.103 | 0.030 | 3.41 | 35.9 | 0.145 | 80.5 | 17.3 | 12.0 | 4.5 |
| Working Example 18 | 1.83 | 4.64 | 0.39 | 0.200 | 0.038 | 5.33 | 34.8 | 0.174 | 76.8 | 22.6 | 12.0 | 8.4 |
| Working Example 19 | 1.66 | 4.12 | 0.40 | 0.182 | 0.038 | 4.73 | 38.3 | 0.159 | 72.9 | 18.9 | 12.0 | 15.8 |
| Working Example 20 | 1.40 | 3.80 | 0.37 | 0.410 | 0.044 | 9.31 | 36.2 | 0.167 | 62.9 | 25.5 | 12.0 | 26.8 |
| Working Example 21 | 1.36 | 3.59 | 0.38 | 0.460 | 0.048 | 9.65 | 35.8 | 0.171 | 59.8 | 28.3 | 15.0 | 35.8 |
| Comparative Example 1 | 2.15 | 4.90 | 0.44 | 0.069 | 0.033 | 2.06 | 42.3 | 0.164 | 63.3 | 8.1 | 1.0 | 0.0 |
| Comparative Example 2 | 2.07 | 4.87 | 0.42 | 0.077 | 0.037 | 2.11 | 41.9 | 0.178 | 58.5 | 7.3 | 1.0 | 0.0 |
| Comparative Example 3 | 2.24 | 4.91 | 0.46 | 0.063 | 0.035 | 1.81 | 41.2 | 0.171 | 59.9 | 7.3 | 1.0 | 0.0 |
| Comparative Example 4 | 2.26 | 4.93 | 0.46 | 0.060 | 0.031 | 1.93 | 39.3 | 0.153 | 61.4 | 7.5 | 1.0 | 0.0 |
| Comparative Example 5 | 2.31 | 4.96 | 0.47 | 0.052 | 0.039 | 1.34 | 38.7 | 0.193 | 65.3 | 9.2 | 1.0 | 0.0 |
| Comparative Example 6 | 2.26 | 4.96 | 0.46 | 0.072 | 0.035 | 2.07 | 42.1 | 0.173 | 85.2 | 8.4 | 1.0 | 0.0 |

INDEX A: APPARENT DENSITY/TRUE DENSITY
INDEX B: BET(O)/BET(D)

TABLE 3

| | | IMAGE DENSITY | FOGGING | WHITE SPOT | FINE-LINE REPRODUCIBILITY | IMAGE QUALITY |
|---|---|---|---|---|---|---|
| NO. OF PRINTED COPIES (INITIAL STATE) | Working Example 1 | ◎ | ◎ | ◎ | ◎ | ◎ |
| | Working Example 2 | ◎ | ◎ | ◎ | ◎ | ○ |
| | Working Example 3 | ◎ | ◎ | ◎ | ◎ | ◎ |
| | Working Example 4 | ◎ | ○ | ◎ | ◎ | ◎ |
| | Working Example 5 | ◎ | ◎ | ○ | ◎ | ○ |
| | Working Example 6 | ◎ | ◎ | ◎ | ○ | ◎ |
| | Working Example 7 | ◎ | ○ | ◎ | ◎ | ○ |
| | Working Example 8 | ◎ | ◎ | ○ | ◎ | ◎ |
| | Working Example 9 | ◎ | ◎ | ◎ | ◎ | ◎ |
| | Working Example 10 | ◎ | ◎ | ◎ | ○ | ○ |
| | Working Example 11 | ◎ | ◎ | ◎ | ◎ | ◎ |
| | Working Example 12 | ◎ | ◎ | ◎ | ◎ | ○ |
| | Working Example 13 | ◎ | ◎ | ◎ | ◎ | ◎ |
| | Working Example 14 | ◎ | ◎ | ◎ | ◎ | ◎ |
| | Working Example 15 | ◎ | ◎ | ◎ | ◎ | ◎ |
| | Working Example 16 | ◎ | ◎ | ○ | ◎ | ◎ |
| | Working Example 17 | ◎ | ◎ | ◎ | ◎ | ◎ |
| | Working Example 18 | ◎ | ◎ | ◎ | ○ | ◎ |
| | Working Example 19 | ◎ | ○ | ◎ | ◎ | ◎ |
| | Working Example 20 | ◎ | ◎ | ◎ | ◎ | ◎ |
| | Working Example 21 | ◎ | ◎ | ◎ | ◎ | ◎ |
| | Comparative Example 1 | ◎ | ○ | ◎ | ◎ | Δ |
| | Comparative Example 2 | ◎ | ◎ | ◎ | ◎ | ◎ |
| | Comparative Example 3 | ◎ | ○ | ◎ | ◎ | ◎ |
| | Comparative Example 4 | ○ | ◎ | ◎ | ◎ | ◎ |
| | Comparative Example 5 | ◎ | ○ | ◎ | ◎ | ○ |
| | Comparative Example 6 | ◎ | ○ | ◎ | ◎ | ○ |
| NO. OF PRINTED COPIES (50,000) | Working Example 1 | ◎ | ○ | ◎ | ◎ | ◎ |
| | Working Example 2 | ○ | ◎ | ○ | ◎ | ○ |
| | Working Example 3 | ◎ | ○ | ◎ | ◎ | ○ |
| | Working Example 4 | ◎ | ○ | ◎ | ◎ | ◎ |
| | Working Example 5 | ◎ | ◎ | ○ | ◎ | ○ |
| | Working Example 6 | ◎ | ◎ | ◎ | ○ | ◎ |
| | Working Example 7 | ○ | ○ | ◎ | ◎ | ○ |
| | Working Example 8 | ◎ | ◎ | ○ | ◎ | ○ |
| | Working Example 9 | ◎ | ◎ | ◎ | ○ | ◎ |
| | Working Example 10 | ◎ | ◎ | ◎ | ○ | ◎ |
| | Working Example 11 | ◎ | ○ | ◎ | ◎ | ◎ |

TABLE 3-continued

| | | IMAGE DENSITY | FOGGING | WHITE SPOT | FINE-LINE REPRODUCIBILITY | IMAGE QUALITY |
|---|---|---|---|---|---|---|
| | Working Example 12 | ○ | ◎ | ○ | ◎ | ○ |
| | Working Example 13 | ○ | ◎ | ○ | ◎ | ◎ |
| | Working Example 14 | ◎ | ○ | ◎ | ◎ | ◎ |
| | Working Example 15 | ◎ | ◎ | ◎ | ○ | ◎ |
| | Working Example 16 | ○ | ◎ | ○ | ◎ | ◎ |
| | Working Example 17 | ◎ | ◎ | ◎ | ◎ | ◎ |
| | Working Example 18 | ◎ | ◎ | ◎ | ○ | ◎ |
| | Working Example 19 | ◎ | ○ | ◎ | ◎ | ◎ |
| | Working Example 20 | ○ | ◎ | ◎ | ◎ | ○ |
| | Working Example 21 | ◎ | ◎ | ○ | ◎ | ◎ |
| | Comparative Example 1 | ◎ | Δ | ◎ | ○ | Δ |
| | Comparative Example 2 | ○ | ○ | ○ | ○ | ◎ |
| | Comparative Example 3 | ○ | Δ | ○ | ◎ | ○ |
| | Comparative Example 4 | Δ | ○ | ◎ | ○ | ○ |
| | Comparative Example 5 | ○ | Δ | ○ | ○ | Δ |
| | Comparative Example 6 | ○ | Δ | ○ | ◎ | Δ |
| NO. OF PRINTED PRINTED COPIES (100,000) | Working Example 1 | ◎ | ○ | ◎ | ○ | ◎ |
| | Working Example 2 | ○ | ◎ | ○ | ◎ | Δ |
| | Working Example 3 | ○ | ○ | ◎ | ○ | ○ |
| | Working Example 4 | ○ | ○ | ○ | ○ | ◎ |
| | Working Example 5 | ◎ | ○ | ○ | ◎ | ○ |
| | Working Example 6 | ◎ | ○ | ○ | Δ | ◎ |
| | Working Example 7 | ○ | ○ | ◎ | ○ | ○ |
| | Working Example 8 | ◎ | ○ | ○ | ◎ | ○ |
| | Working Example 9 | ◎ | ◎ | ○ | ○ | ○ |
| | Working Example 10 | ○ | ○ | ○ | ○ | ◎ |
| | Working Example 11 | ◎ | ○ | ◎ | ◎ | ○ |
| | Working Example 12 | ○ | ◎ | ○ | ◎ | ○ |
| | Working Example 13 | ○ | ◎ | ○ | ○ | ○ |
| | Working Example 14 | ◎ | ○ | ○ | ◎ | ○ |
| | Working Example 15 | ◎ | ◎ | ◎ | ○ | ○ |
| | Working Example 16 | ○ | ◎ | ○ | ◎ | ○ |
| | Working Example 17 | ◎ | ◎ | ○ | ○ | ◎ |
| | Working Example 18 | ◎ | ◎ | ○ | ○ | ◎ |
| | Working Example 19 | ◎ | ○ | ◎ | ○ | ○ |
| | Working Example 20 | ○ | ○ | ○ | ◎ | ○ |
| | Working Example 21 | ◎ | ○ | ◎ | ○ | ○ |
| | Comparative Example 1 | ○ | X | ○ | Δ | X |

TABLE 3-continued

| | | IMAGE DENSITY | FOGGING | WHITE SPOT | FINE-LINE REPRODUCIBILITY | IMAGE QUALITY |
|---|---|---|---|---|---|---|
| | Comparative Example 2 | X | Δ | Δ | X | ○ |
| | Comparative Example 3 | Δ | X | Δ | Δ | Δ |
| | Comparative Example 4 | Δ | Δ | ○ | X | X |
| | Comparative Example 5 | X | X | Δ | Δ | X |
| | Comparative Example 6 | Δ | X | Δ | ○ | X |
| NO. OF PRINTED COPIES (150,000) | Working Example 1 | ○ | ○ | ○ | ○ | ◎ |
| | Working Example 2 | ○ | ◎ | Δ | ○ | Δ |
| | Working Example 3 | Δ | ○ | ○ | Δ | ○ |
| | Working Example 4 | ○ | Δ | ○ | ○ | ○ |
| | Working Example 5 | ○ | ○ | ○ | ○ | Δ |
| | Working Example 6 | ◎ | ○ | ○ | Δ | ○ |
| | Working Example 7 | ○ | Δ | ○ | ○ | ○ |
| | Working Example 8 | ○ | ○ | Δ | ○ | Δ |
| | Working Example 9 | ◎ | ○ | ○ | Δ | ○ |
| | Working Example 10 | ○ | Δ | ○ | ○ | ○ |
| | Working Example 11 | ○ | ○ | ○ | ○ | ○ |
| | Working Example 12 | ○ | ◎ | Δ | ○ | Δ |
| | Working Example 13 | ○ | ○ | ○ | Δ | ○ |
| | Working Example 14 | ◎ | Δ | ○ | ○ | ○ |
| | Working Example 15 | ○ | ○ | ◎ | Δ | ○ |
| | Working Example 16 | ○ | ○ | ○ | ○ | Δ |
| | Working Example 17 | ○ | ◎ | ○ | ○ | ○ |
| | Working Example 18 | ○ | ◎ | Δ | ○ | ◎ |
| | Working Example 19 | ◎ | ○ | ○ | ○ | ○ |
| | Working Example 20 | ○ | ○ | ○ | ○ | ○ |
| | Working Example 21 | ○ | Δ | ◎ | ○ | ○ |
| | Comparative Example 1 | Δ | X | Δ | Δ | X |
| | Comparative Example 2 | X | Δ | X | X | Δ |
| | Comparative Example 3 | Δ | X | Δ | X | Δ |
| | Comparative Example 4 | X | Δ | X | X | X |
| | Comparative Example 5 | X | X | X | Δ | X |
| | Comparative Example 6 | Δ | X | Δ | Δ | X |

The invention claimed is:

1. An electrophotographic developer carrier core material that is obtained by mixing, and optionally calcining, a starting material comprising:

(a) 0.5 μm to 2 μm diameter particles formed by pulverizing a mixture comprising magnetic oxide powder and resin, or silica particles with an average particle size of 1 μm to 10 μm mixed with 0.5 μm to 2 μm particles formed by pulverizing magnetic oxide powder;

(b) a binder;

(c) a dispersant;

to form a mixed material, and sintering said mixed material, wherein $0.25 \leq A \leq 0.40$ is satisfied where A is an apparent density/true density ratio of the electrophotographic developer carrier core material, the apparent density of the electrophotographic developer carrier core material is 2.0 g/cm$^3$ or less.

2. The electrophotographic developer carrier core material according to claim 1, wherein BET(0)≥0.07 $m^2/g$ and 3.0≤BET(0)/BET(D)≤10.0 are satisfied where BET(0) expresses a value of a specific surface area of the electrophotographic developer carrier core material as measured by a BET method and BET(D) expresses a value of a sphere-converted specific surface area of the electrophotographic developer carrier core material obtained by dividing a cs (Calculated Specific Surface Area) value determined by a wet dispersion-type particle size distribution measurement apparatus by the true density.

3. The electrophotographic developer carrier core material according to claim 1, wherein the electrophotographic developer carrier core material obtained by sintering the mixed material contains:

a sintered magnetic oxide, and a non-magnetic oxide having a true specific gravity of 3.5 or less.

4. The electrophotographic developer carrier core material according to claim 3, wherein the sintered magnetic oxide is a soft ferrite.

5. The electrophotographic developer carrier core material according to claim 3, wherein the non-magnetic oxide is contained in an amount 1 wt % or more and 50 wt % or less of the electrophotographic developer carrier core material.

6. An electrophotographic developer carrier that is formed by coating the electrophotographic developer carrier core material according to claim 1 with a coating resin.

7. The electrophotographic developer carrier according to claim 6, wherein an amount of the coating resin is 0.1 wt % or more and, 20.0 wt % or less of the electrophotographic developer carrier.

8. The electrophotographic developer carrier according to claim 6, wherein an average particle size of the electrophotographic developer carrier is 25 μm or more and 50 μm or less.

9. The electrophotographic developer carrier according to claim 6, wherein 1 wt % or more and 50 wt % or less of silica is contained in the electrophotographic developer carrier.

10. An electrophotographic developer that comprises the electrophotographic developer carrier according to claim 6.

11. The electrophotographic developer carrier core material according to claim 3, wherein the non-magnetic oxide is a member selected from the group consisting of $SiO_2$, $Al_2O_3$, $Al(OH)_2$ and $B_2O_3$.

12. The electrophotographic developer carrier core material according to claim 3, wherein the non-magnetic oxide is contained in the electrophotographic developer carrier core material in an amount from 5 wt % to 40 wt %.

13. The electrophotographic developer carrier core material according to claim 3, wherein the sintered magnetic oxide is a member selected from the group consisting of Spinel-type ferrites, Magnetoplumbite-type ferrites, Garnet-type ferrites, Perovskite-type ferrites, and Ilmenite-type ferrites.

14. The electrophotographic developer carrier core material according to claim 3, wherein the sintered magnetic oxide is a Spinel-type ferrite expressed by a general formula $M^{2+}O.Fe_2O_3$ or $M^{2+}.Fe_2O_4$, where M is a member selected from the group consisting of Mn, Mg, Fe, Co, Ni, Cu, and Zn.

15. The electrophotographic developer carrier core material according to claim 3, wherein the sintered magnetic oxide is a Magnetoplumbite-type ferrite expressed by a general formula $M^{2+}O.6Fe_2O_3$, where M is a member selected from the group consisting of Ba, Sr, and Pb.

16. The electrophotographic developer carrier core material according to claim 3, wherein the sintered magnetic oxide is a Garnet-type ferrite expressed by a general formula $3M^{3+}{}_2O_3.5Fe_2O_3$ or $M^{3+}{}_3Fe_5O_{12}$, where M is a member selected from the group consisting of Sm, Eu, Gd, Tb, Dy, Ho, Er, Tm, Yb, and Lu.

17. The electrophotographic developer carrier core material according to claim 1, wherein the starting material comprises:

(a) the 0.5 μm to 2 μm diameter particles formed by pulverizing a starting material mixture comprising magnetic oxide powder and resin, (b) the binder, and (c) the dispersant; and said mixed material is formed by mixing and calcining the starting material.

18. The electrophotographic developer carrier core material according to claim 1, wherein the starting material comprises:

(a) the silica particles with an average particle size of 1 μm to 10 μm mixed with 0.5 μm to 2 μm diameter particles formed by pulverizing magnetic oxide powder, (b) the binder, and (c) the dispersant; and said mixed material is formed by mixing the starting material.

* * * * *